US008958724B2

(12) United States Patent
Nakaue et al.

(10) Patent No.: US 8,958,724 B2
(45) Date of Patent: Feb. 17, 2015

(54) DEVELOPING DEVICE AND IMAGE FORMING APPARATUS

(71) Applicant: KYOCERA Document Solutions Inc., Osaka (JP)

(72) Inventors: Takahisa Nakaue, Osaka (JP); Minoru Wada, Osaka (JP); Shizuka Okada, Osaka (JP); Takefumi Yotsutsuji, Osaka (JP); Akifumi Yamaguchi, Osaka (JP); Tamotsu Shimizu, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/085,057

(22) Filed: Nov. 20, 2013

(65) Prior Publication Data

US 2014/0140734 A1 May 22, 2014

(30) Foreign Application Priority Data

Nov. 22, 2012 (JP) ..... 2012-256075

(51) Int. Cl.
*G03G 15/08* (2006.01)

(52) U.S. Cl.
CPC ..... *G03G 15/0893* (2013.01); *G03G 15/0879* (2013.01)
USPC ..... 399/255

(58) Field of Classification Search
USPC ..... 399/255
See application file for complete search history.

(56) References Cited

U.S. PATENT DOCUMENTS

| | | | | |
|---|---|---|---|---|
| 2011/0236074 | A1* | 9/2011 | Maeda et al. | 399/254 |
| 2012/0045252 | A1* | 2/2012 | Mihara et al. | 399/254 |
| 2012/0070194 | A1* | 3/2012 | Okuno | 399/254 |
| 2013/0051860 | A1* | 2/2013 | Maehara et al. | 399/254 |
| 2013/0202329 | A1* | 8/2013 | Akedo | 399/258 |

FOREIGN PATENT DOCUMENTS

JP 2004-151340 A 5/2004

* cited by examiner

*Primary Examiner* — Clayton E Laballe
*Assistant Examiner* — Linda B Smith
(74) *Attorney, Agent, or Firm* — Knobbe, Martens, Olson & Bear LLP

(57) ABSTRACT

A developing device of this disclosure has: a housing, a developing roller, a developer conveying path, a partition board, a second communication path, a developer receiving port, a first conveying member, a second conveying member, and a conveyance capability inhibition part. A toner is cyclically conveyed in a first conveying path and a second conveying path. A first stirring screw is disposed in the first conveying path and driven into ration around a first rotation axis for toner conveyance. Formed downstream of the first stirring screw by the conveyance capability inhibition part is a toner accumulation part, and the amount of toner refilled from a toner refill port is adjusted. Where an aperture area of the first communication path is A1 and a circular area formed by an outer circumferential edge of the first stirring screw in section orthogonal to the first rotation axis is A2, relationship $0.5\times A2<A1<1.2\times A2$ is satisfied.

12 Claims, 9 Drawing Sheets

DEVELOPING DEVICE AND IMAGE FORMING APPARATUS

INCORPORATION BY REFERENCE

This application claims priority to Japanese Patent Application No. 2012-256075 filed on 22, Nov. 2012, the entire contents of which are incorporated by reference herein.

BACKGROUND

This disclosure relates to a developing device preferably loaded in an image forming apparatus, such as a copier or a printer, and the image forming apparatus provided therewith.

A developing device includes: a developing housing including a developing roller and a spiral screw; and a toner container for toner refilling fitted detachably to the developing housing. Provided at a bottom part of the toner container is an openable and closable toner discharge port, and provided in the developing housing at a position corresponding to the toner discharge port is a toner refill port. When the toner container is fitted to the developing housing and then the toner discharge port and the toner refill port are opened, a toner in the toner container is supplied to a predetermined circulatory conveying path formed in the developing housing.

The circulatory conveying path is composed of an outward conveying path corresponding to the toner refill port; and a returning conveying path corresponding to the developing roller. Each circulatory conveying path is fitted with a stirring screw having a spiral blade disposed around its rotation axis. The toner is cyclically conveyed between the outward conveying path and the returning conveying path by these stirring screws.

In the developing device having such configuration, downstream of the toner refill port of the stirring screw provided in the outward conveying path, a conveyance capability inhibition part is provided which is configured such that a conveyance capability deteriorates locally. By such a conveyance capability inhibition part, near the toner refill port upstream of the conveyance capability inhibition part, a toner accumulation part is formed. If the amount of toner in the accumulation part is large, the toner in this accumulation part closes the toner refill port. If the amount of toner in the accumulation part is small, a gap is formed between the toner refill port and the toner accumulation port, and the toner flows from a toner container side into the developing housing. As described above, in accordance with the amount of toner accumulating in the accumulation part, the amount of toner refilled from the toner container into the developing housing is adjusted.

SUMMARY

A developing device according to one aspect of this disclosure has: a housing, a developing roller, a developer conveying path, a partition board, a first communication path, a second communication path, a developer receiving port, a first conveying member, a second conveying member, and a conveyance capability inhibition part.

The housing includes a pair of wall parts.

The developing roller is rotatably supported in the housing between the pair of wall parts, and carries a developer.

The developer conveying path includes a first conveying path and a second conveying path. The first conveying path is arranged in a manner such as to be spaced from the developing roller and conveys the developer in a first direction. The second conveying path is arranged between the developing roller and the first conveying path, conveys the developer in a second direction opposite to the first direction, and supplies the developer to the developing roller.

The partition board is arranged in the housing in a manner such as to extend in a direction orthogonal to the pair of wall parts, and partitions the first conveying path and the second conveying path.

The first communication path and the second communication path respectively are arranged between the pair of wall parts and both end parts of the partition board, the first communication path passes the developer from the first conveying path to the second conveying path, and the second communication path passes the developer from the second conveying path to the first conveying path.

The developer receiving port is disposed at a position on a downstream side in the first direction of the first conveying path in the housing, and receives a refill developer into the developer conveying path.

The first conveying member is disposed in the first conveying path, includes a first rotation axis, is driven into rotation around the first rotation axis, and conveys the developer in the first direction in the first conveying path in a manner such that the developer passes through a position opposing the developer receiving port.

The second conveying member is disposed in the second conveying path, includes a second rotation axis, is driven into rotation around the second rotation axis, and conveys the developer in the second direction.

The conveyance capability inhibition part is arranged on a side downstream of the developer receiving port of the first conveying member in the first direction, and partially inhibits a capability of conveying the developer by the first conveying member to thereby form an accumulation part for the developer at a position opposing the developer receiving port.

Where an aperture area of a region in the first communication path through which the developer passes is defined as A1 and an area of a circular section formed by an outer circumferential edge of the first conveying member in section orthogonal to the first rotation axis is defined as A2, relationship: $0.5 \times A2 < A1 < 1.2 \times A2$ is satisfied.

DETAILED DESCRIPTION

Figure 1:
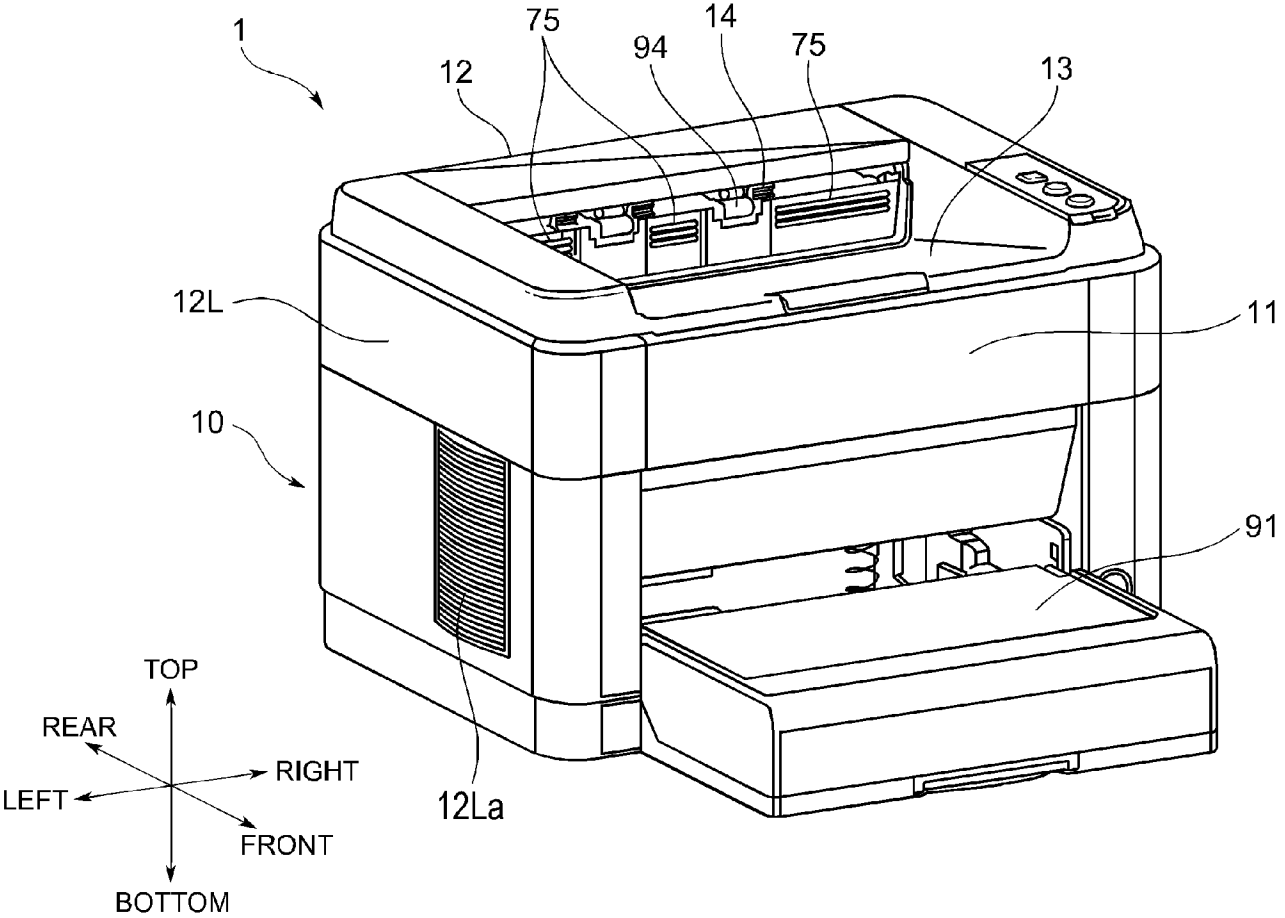
FIG. 1 is a perspective view showing exterior appearance of an image forming apparatus according to one embodiment of this disclosure.
Figure 2:
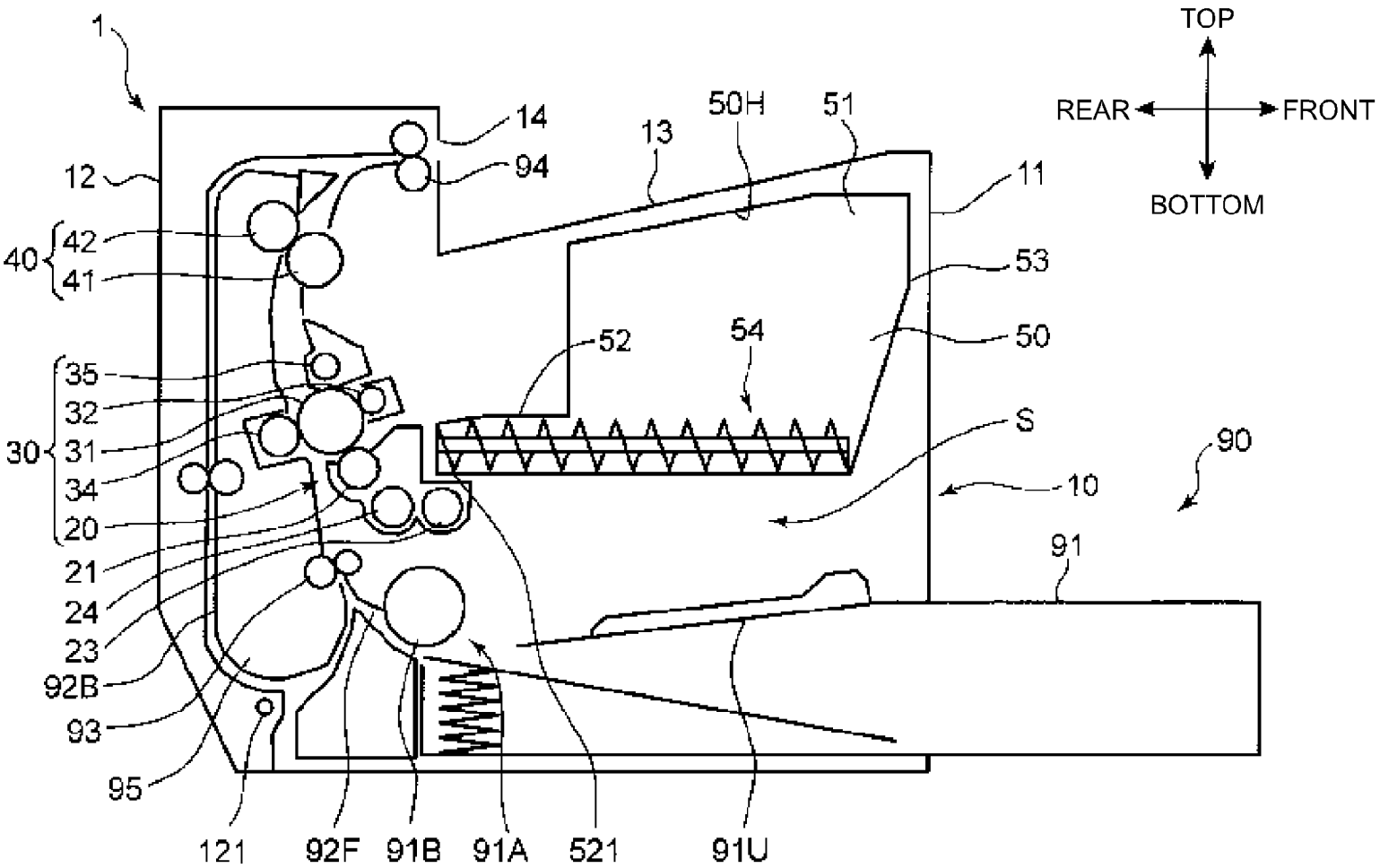
FIG. 2 is a sectional view showing internal structure of the image forming apparatus according to one embodiment of this disclosure.

Hereinafter, based on the drawings, an embodiment of this disclosure will be described in detail. FIG. 1 is a perspective view showing exterior appearance of an image forming apparatus 1 according to one embodiment of this disclosure. FIG. 2 is a side sectional view showing internal structure of the image forming apparatus 1 according to one embodiment of this disclosure. Here, illustrated as the image forming apparatus 1 is a black and white printer, but the image forming apparatus may be a copier, a facsimile device, or a complex machine including the aforementioned functions, or an image forming apparatus forming a color image.

The image forming apparatus 1 includes: a main body housing 10 having a casing structure of a substantially rectangular shape; an image forming part 30; a fixing part 40; a toner container 50; and a paper feed part 90 which are all stored in this main body housing 10.

On a front side of the main body housing 10, a front cover 11 is provided, and on a rear side of the main body housing 10, a rear cover 12 is provided. As a result of opening the front cover 11, the toner container 50 is exposed to the front. As a result, a user can take out the toner container 50 from the front side of the main body housing 10 upon toner depletion. The rear cover 12 is a cover opened upon sheet jam or maintenance. As a result of opening of the rear cover 12, each unit of the image forming part 30 and the fixing unit 40 can be taken out from the rear side of the main body housing 10.

Moreover, on side surfaces of the main body housing 10, a left cover 12L (FIG. 1) and a right cover (not shown in FIG. 1) opposite to the left cover 12L are respectively disposed in a manner such as to extend vertically. Disposed at a front side portion of the left cover 12L is a suction port 12La for introducing air into the main body housing 10. Moreover, provided on a top surface of the main body housing 10 is a paper discharge part 13 to which a sheet with an image already formed thereon is discharged. In an internal space S (FIG. 2) defined by the front cover 11, the rear cover 12, the left cover 12L, the right cover 12R, and the paper discharge part 13, various devices for executing image formation are fitted.

The image forming part 30 performs image formation processing in which a toner image is formed on a sheet sent from the paper feed part 90. The image forming part 30 includes: a photosensitive drum 31 (image carrier); and a charging device 32, an exposure device (not shown in FIG. 2), a developing device 20, a transfer roller 34, and a cleaning device 35 which are arranged around the photosensitive drum 31. The image forming part 30 is disposed between the left cover 12L and the right cover 12R.

The photosensitive drum 31 includes: a rotation axis; and a cylindrical surface rotating around the rotation axis. On the cylindrical surface, an electrostatic latent image is formed and also a toner image in accordance with this electrostatic latent image is carried. Used as the photosensitive drum 31 can be a photosensitive drum using an amorphous-silicon (a-Si)-based material.

The charging device 32 evenly charges a surface of the photosensitive drum 31, and includes a charging roller that abuts the photosensitive drum 31.

The cleaning device 35 has a cleaning blade, not shown, and cleans a toner adhering to a circumferential surface of the photosensitive drum 31 on which a toner image is transferred, and also conveys the toner to a collection device, not shown.

Figure 3:
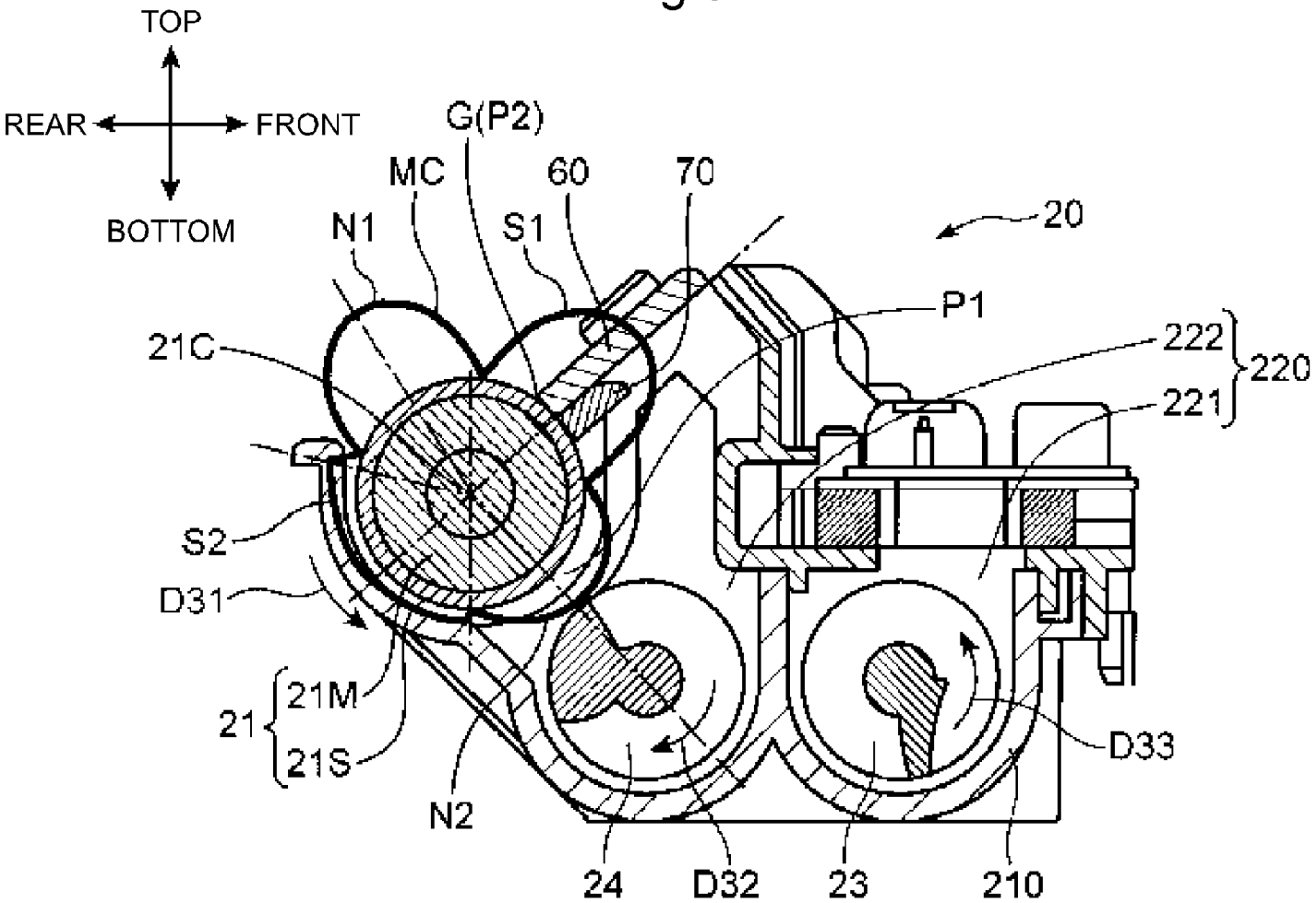
FIG. 3 is a sectional view of a developing device according to one embodiment of this disclosure.

The exposing device has optical devices such as a laser light source, a mirror, and a lens, and irradiates the circumferential surface of the photosensitive drum 31 with light modulated based on image data given from an external device such as a personal computer and thereby forms an electrostatic latent image. The developing device 20, in order to develop the electrostatic latent image on the photosensitive drum 31 to form a toner image, supplies the toner to the circumferential surface of the photosensitive drum 31. The developing device 20 includes: a developing roller 21 carrying a toner supplied to the photosensitive drum 31; and a first stirring screw 24 and a second stirring screw 23 cyclically conveying a developer while stirring it inside a developing housing 210 (FIG. 3). The developing device 20 according to this embodiment will be described in detail later.

The transfer roller 34 is a roller for transferring, onto a sheet, the toner image formed on the circumferential surface of the photosensitive drum 31. The transfer roller 34 abuts the cylindrical surface of the photosensitive drum 31, forming a transfer nip part. This transfer roller 34 is provided with transfer bias with a polarity opposite to that of the toner.

The fixing unit 40 performs fixing processing in which the transferred toner image is fixed on the sheet. The fixing unit 40 includes: a fixing roller 41 having a heat source provided therein; and a pressure roller 42 which is brought into pressure-contact with the fixing roller 41, forming a fixing nip part with the fixing roller 41. Upon passage of the sheet, on which the toner image has been transferred, through the fixing nip part, the toner image is fixed onto the sheet as a result of heating by the fixing roller 41 and pressing by the pressure roller 42.

The toner container 50 pools a toner refilled into the developing device 20. The toner container 50 includes: a container main body 51 serving as a main toner pooling section; a tubular part 52 protruding from a bottom part on one side surface of the container main body 51; a cover member 53 covering another side surface of the container main body 51; and a rotation member 54 which is stored inside the container and which conveys a toner. As a result of driving of the rotation member 54 into rotation, the toner pooled in the toner container 50 is supplied into the developing device 20 from a toner discharge port 521 provided at a tip bottom surface of the tubular part 52. A container top board 50H covering a top of the toner container 50 is located below the paper discharge part 13 (see FIG. 2).

The paper feed part 90 includes a paper feed cassette 91 storing sheets to be subjected to image formation processing (FIG. 2). This paper feed cassette 91 partially protrudes even more forwardly from a front surface of the main body housing 10. Of the paper feed cassette 91, a top surface of a portion stored in the main body housing 10 is covered by a paper feed cassette top board 91U. Provided in the paper feed cassette 91 are: a sheet storage space in which a bundle of the sheets are stored; a lift board that lifts up the bundle of the sheets for the purpose of paper feeding; and so on. Provided at a top part on a rear end side of the paper feed cassette 91 is a sheet feed unit 91A. Arranged on this sheet feed unit 91A is a paper feed roller 91B for individually feeding the sheets at a topmost layer included in the bundle of sheets in the paper feed cassette 91.

Provided in the main body housing 10 are a main conveying path 92F and an inverted conveying path 92B for sheet conveyance. The main conveying path 92F extends via the image forming part 30 and the fixing unit 40 from the sheet feed unit 91A of the paper feed part 90 to a paper discharge port 14 provided oppositely to the paper discharge part 13 on the top surface of the main body housing 10. The inverted conveying path 92B is a conveying path for, upon performance of double-sided printing on a sheet, returning the sheet subjected to one-sided printing to an upstream side of the image forming part 30 in the main conveying path 92F.

The main conveying path 92F extends in a manner such as to pass through the transfer nip part, which is formed by the photosensitive drum 31 and the transfer roller 34, from a bottom to a top. Moreover, arranged upstream of the transfer nip part in the main conveying path 92F is a registration roller pair 93. The sheet is temporarily stopped at the registration roller pair 93, is subjected to skew correction, and then sent to the aforementioned transfer nip part at predetermined timing for the purpose of image transfer. Arranged at appropriate places of the main conveying path 92F and the inverted conveying path 92B are a plurality of conveying rollers for sheet conveyance, and for example, a paper discharge roller pair 94 is arranged near the paper discharge port 14.

The inverted conveying path 92B is formed between an outer side surface of an inversion unit 95 and an inner surface of the rear cover 12 of the main body housing 10. On an inner side surface of the inversion unit 95, the transfer roller 34 and one roller included in the registration roller pair 93 are loaded. The rear cover 12 and the inversion unit 95 are capable of turning around an axis of a supporting point part 121 provided at their bottom ends. In an event of a sheet jam in the inverted conveying path 92B, the rear cover 12 is opened. In an event of a sheet jam in the main conveying path 92F, or when any unit of the photosensitive drum 31 or the developing device 20 is to be taken out, the inverting unit 95 in addition to the rear cover 12 is opened.

<Description of Developing Device>

Figure 4:
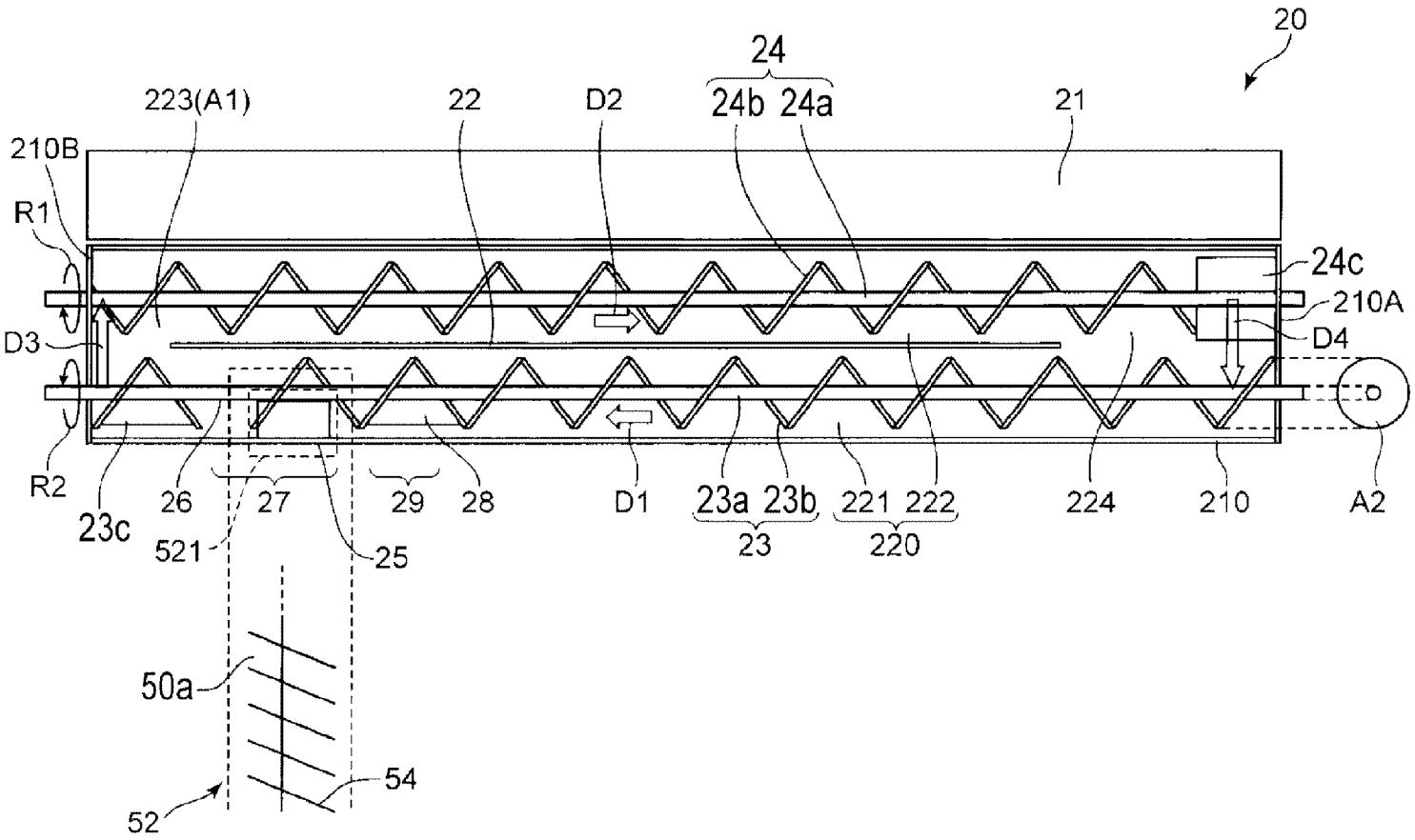
FIG. 4 is a plan view of the developing device according to one embodiment of this disclosure.

Next, the developing device 20 according to this embodiment will be described in detail. FIG. 3 is a sectional view showing inner structure of the developing device 20. FIG. 4 is a plan view showing inner structure of the developing device 20. The developing device 20 includes: the developing housing 210 (casing) having a box shape elongated in one direction (axial direction of the developing roller 21). The developing housing 210 includes: a first wall part 210A and a second wall part 210B in a pair. This developing housing 210 has an inner space 220 between the first wall part 210A and the second wall part 210B. Disposed in the inner space 220 are: the developing roller 21, a first stirring screw 23 (first conveying member), a second stirring screw 24 (second conveying member), and a toner refill port 25. In this embodiment, as one-component development method, a toner containing a magnetic material is filled as a developer into this inner space 220. The toner is conveyed while stirred in the inner space 220, and is successively supplied from the developing roller 21 to the photosensitive drum 31 (FIG. 2) for the purpose of developing an electrostatic latent image.

The developing roller 21 is rotatably supported between the first wall part 210A and the second wall part 210B in a pair in the developing housing 210, and carries a magnetic toner on its surface. The developing roller 21 has a cylindrical shape extending in a lengthwise direction of the developing housing 210. The developing roller 21 includes: a sleeve 21S of a cylindrical shape that is driven into rotation; and a magnet 21M of a circular-cylinder shape that is firmly arranged along an axial direction inside the sleeve 21S. The sleeve 21S is driven by driving means, not shown, into rotation in the direction of the arrow D31 of FIG. 3, and carries a magnetic toner on its circumferential surface. The magnet 21M is a stationary magnet having, inside the sleeve 21S, a plurality of magnetic poles in a circumferential direction of the sleeve 21S. The magnet 21M includes the four magnetic poles: pole S1, pole N1, pole S2, and pole N2 arranged in the circumferential direction.

In FIG. 3, a curve MC surrounding the developing roller 21 denotes magnetic force in a radius direction of the developing roller 21 which force is provided by the different magnetic poles, in distribution in the circumferential direction on the sleeve 21S. The pole S1 of the magnet 21M is arranged at a top front position. The pole S1 is used as a regulating pole for toner layer regulation. The pole N1 of the magnet 21M is arranged at a top rear position. The pole N1 is provided with, as a developing pole, a function of supplying a toner to the photosensitive drum 31. The pole N2 of the magnet 21M is arranged at a bottom front position. The pole N2 is provided with, as a catch pole, a function of pumping up the toner to the developing roller 21. The pole S2 of the magnet 21M is arranged at a position which is downstream of the pole N1 in a rotation direction of the sleeve 21S and is also upstream of the pole N2 in the rotation direction of the sleeve 21S. The pole S2 of the magnet 21M is mainly arranged at a bottom rear position. The pole S2 is provided with a function as a conveying pole which collects, in the developing housing 210, the toner not moved towards the photosensitive drum 31 at the pole N1. The toner carried on the sleeve 21S is conveyed to an aperture part (not shown) disposed at the developing housing 210, and is supplied to the opposing photoconductive drum 31.

The inner space 220 of the developing housing 210 is covered by a top board, not shown, and also is divided by a partition board 22 extending in a horizontal direction into a first conveying path 221 and a second conveying path 222 which are elongated in the horizontal direction. The partition board 22 is shorter than a horizontal width of the developing housing 210, and between left and right ends of the partition board 22 and the second wall part 210B and the first wall part 210A, a first communication path 223 and a second communication path 224 are provided each of which communicates the first conveying path 221 and the second conveying path 222 with each other. As a result, formed in the inner space 220 is a circulation path (developer conveying path) that reaches the first conveying path 221, the first communication path 223, the second conveying path 222, and the second communication path 224. The toner is conveyed clockwise in FIG. 4 in this circulation path. Note that, for example, an auxiliary partition board 22B (F FIG. 7) to be described later may be arranged in the first communication path 223.

The toner refill port 25 is an aperture part pierced through the top board, and is arranged at a top of the first conveying path 221 near a left end thereof (FIG. 4). The toner refill port 25 is arranged oppositely to the aforementioned circulation path, and is provided with a function of receiving in the inner space 220 a refill toner refilled from the toner container 50 (FIG. 2). In this embodiment, the toner refill port 25 is formed of an aperture dimensioned 14 mm×8 mm in a plan view.

The first stirring screw 23 is disposed in the first conveying path 221. The first stirring screw 23 includes: a first rotation axis 23*a*; and a first spiral blade 23*b* (screw blade) protruding spirally from a circumference of the first rotation axis 23*a*. The first stirring screw 23 is driven by driving means, not shown, into rotation around the first rotation axis 23*a* (arrow D33 of FIG. 3 and arrow R2 of FIG. 4) to thereby convey the toner in a direction of an arrow D1 of FIG. 4. The first stirring screw 23 conveys the developer in a manner such that it passes through a position at which the toner refill port 25 opposes the first conveying path 221. As a result, the first stirring screw 23 has a function of mixing a new toner flowing from the toner refill port 25 with the toner conveyed through the first conveying path 221 and then delivering the mixed toner towards the second conveying path 222. In this embodiment, an outer diameter of the first spiral blade 23*b* is 14 mm and its axial pitch is set at 20 mm. In accordance with conveyance performance of the first stirring screw 23, the aforementioned pitch can be changed, but it is preferable in terms of maintaining a toner conveyance capability that a lower limit of the aforementioned pitch be set at 15 mm. Disposed on a downstream side in a toner conveyance direction of the first stirring screw 23 is a first paddle 23*c*. The first paddle 23*c* is a rib member extending in an axial direction across one pitch of the first spiral blade 23*b*. The first paddle 23*c* is rotated together with the first rotation axis 23*a*, and delivers the toner from the first conveying path 221 to the second conveying path 222 in the direction of the arrow D3 of FIG. 4. In this embodiment, an axial length of the first paddle 23*c* is set at 20 mm.

The second stirring screw 24 is disposed in the second conveying path 222. The second stirring screw 24 includes: a second rotation axis 24*a*; and a second spiral blade 24*b* (screw blade) protruding spirally on a circumference of this second rotation axis 24*a*. The second stirring screw 24 is driven by driving means, not shown, into rotation around the second rotation axis 24*a* (an arrow D32 of FIG. 3 and an arrow R1 of FIG. 4) to thereby convey the toner in a direction of an arrow D2 of FIG. 4 (second direction). The second stirring screw 24 conveys the toner in the second conveying path 222 and also supplies the toner to the developing roller 21. In this embodiment, an outer diameter of the second spiral blade 24*b* is 14 mm and its axial pitch is set at 20 mm. In accordance with conveyance performance of the second stirring screw 24, the aforementioned pitch can be changed, but it is preferable in terms of maintaining a toner conveyance capability that a lower limit of the aforementioned pitch be 15 mm.

The second stirring screw 24 is arranged at a position more front and lower than the developing roller 21. That is, the second stirring screw 24 is arranged oppositely to the pole N2 of the magnet 21M. Following the rotation of the second stirring screw 24 (the arrow D32 of FIG. 3), the toner is supplied from the second stirring screw 24 to the sleeve 21S. The second rotation axis 24*a* of the second stirring screw 24 is located below a rotation axis of the sleeve 21S. Further, the second rotation axis 24*a* of the second stirring screw 24 is located below a bottom end part of a circumferential surface of the sleeve 21S. In this embodiment, a path of the toner supply to the developing roller 21 is formed only by a path of the supply from the second stirring screw 24. Therefore, the second stirring screw 24 pumps up the toner from a bottom to a top towards the developing roller 21 to thereby supply the toner to the sleeve 21S.

Disposed on a downstream side in the toner conveyance direction (direction D2) of the second stirring screw 24 is a second paddle 24*c*. The second paddle 24*c* is a plate-like member disposed on the second rotation axis 24*a*. The second paddle 24*c* is rotated together with the second rotation axis 24*a*, and delivers the toner from the second conveying path 222 to the first conveying path 221 in a direction of an arrow D4 of FIG. 4. In this embodiment, an axial length of the second paddle 24*c* is set at 20 mm.

The developing device 20 further includes: a layer regulating member 60 and a magnet plate 70.

The layer regulating member 60 is arranged at a position more front and upper than the developing roller 21. The layer regulating member 60 is arranged along an axial direction of the developing roller 21 oppositely to the circumferential surface of the developing roller 21 (sleeve 21S). More specifically, the layer regulating member 60 is arranged oppositely to the pole S1 of the magnet 21M included in the developing roller 21. The layer regulating member 60 is a plate-like member formed of a magnetic material. The layer regulating member 60 has a rectangular shape having a longer side extending in a direction towards the developing roller 21 in cross section orthogonal to the rotation axis of the developing roller 21. A tip end part of the layer regulating member 60 is so arranged as to be spaced from the sleeve 21S of the developing roller 21. As a result, between this tip end part and the sleeve 21S, a layer regulating gap G is formed. The layer regulating member 60 regulates a layer thickness of the toner pumped up from the second stirring screw 24 onto the sleeve 21S.

The magnet plate 70 is arranged in front of the layer regulating member 60 along the layer regulating member 60. In other words, the magnet plate 70 is arranged on a side upstream of the layer regulating member 60 in a rotation direction (arrow D31 of FIG. 3) of the sleeve 21S of the developing roller 21. In this embodiment, the magnet plate 70 is formed of a permanent magnet having a plate-like shape. The magnet plate 70 has a substantially rectangular shape extending along the layer regulating member 60 in cross section orthogonal to the rotation axis of the developing roller 21. The magnet plate 70 is fixed at a bottom portion of the layer regulating member 60. The magnet plate 70 is provided with magnetic force of a south pole same in polarity as the pole S1. Moreover, the magnet plate 70 includes a north pole at a position more distant from the pole S1 of the magnet 21M than the aforementioned south pole.

As described above, in this embodiment, the magnet plate 70 is arranged on the side upstream of the layer regulating member 60 in the rotation direction of the developing roller 21 (sleeve 21S). In other words, from the upstream side towards a downstream side in the rotation direction of the developing roller 21, the magnet plate 70 and the layer regulating member 60 are arranged oppositely to the circumferential surface of the developing roller 21 in just mentioned order.

Thus, in this embodiment, the second stirring screw 24 supplies the toner to the sleeve 21S in a direction towards a first position P1 facing a vertical bottom of the circumferential surface of the sleeve 21S, and the layer regulating member 60 regulates a thickness of the toner on the sleeve 21S at a second position P2 which faces a vertical top of the circumferential surface of the sleeve 21S and also which is located above the first position P1. At this point, the pole S1 of the magnet 21M and the south pole of the magnet plate 70 have magnetic force with the same polarity, and therefore a repulsive magnetic field acts between the sleeve 21S and the magnet plate 70. This repulsive magnetic field is classified into a magnetic field directed towards the upstream side in the rotation direction of the sleeve 21S and a magnetic field directed towards the downstream side thereof (layer regulating member 60 side). Thus, the toner conveyed onto the sleeve 21S and entering into a bottom part of the magnet plate 70 is given with force causing its movement to the circumferential surface of the sleeve 21S. As a result, the toner layer regulation is realized while the toner is thinly layered. Further, the toner which did not enter into the layer regulating gap G of the layer regulating member 60 is promoted by the repulsive magnetic field and flows towards the upstream side in the rotation direction of the sleeve 21S.

<Accumulation Part>

The aforementioned toner container 50 is arranged above the toner refill port 25 of the developing housing 210. The toner container 50 includes: a toner conveying path 50*a* inside of which the toner is conveyed; a rotation member 54; and a toner discharge port 521. The toner container 50 is assembled into the developing device 20 in a manner such that a longitudinal direction of the toner container 50 (direction in which the toner conveying path 50*a* extends) is located in a direction orthogonal to a longitudinal direction of the developing device 20 (developer conveying direction of the first stirring screw 23, the direction of the arrow D1, first direction)

The toner discharge port 521 is disposed at a bottom part of the toner container 50 in correspondence with the toner refill port 25 of the developing device 20. The rotation member 54 has: an axis part, and a blade part rotated around the axis part (see FIG. 2), and conveys the refill toner in the toner conveying path 50*a* towards the toner discharge port 521. The toner dropping from the toner discharge port 521 is refilled into the developing device 20 via the toner refill port 25.

Figure 5:
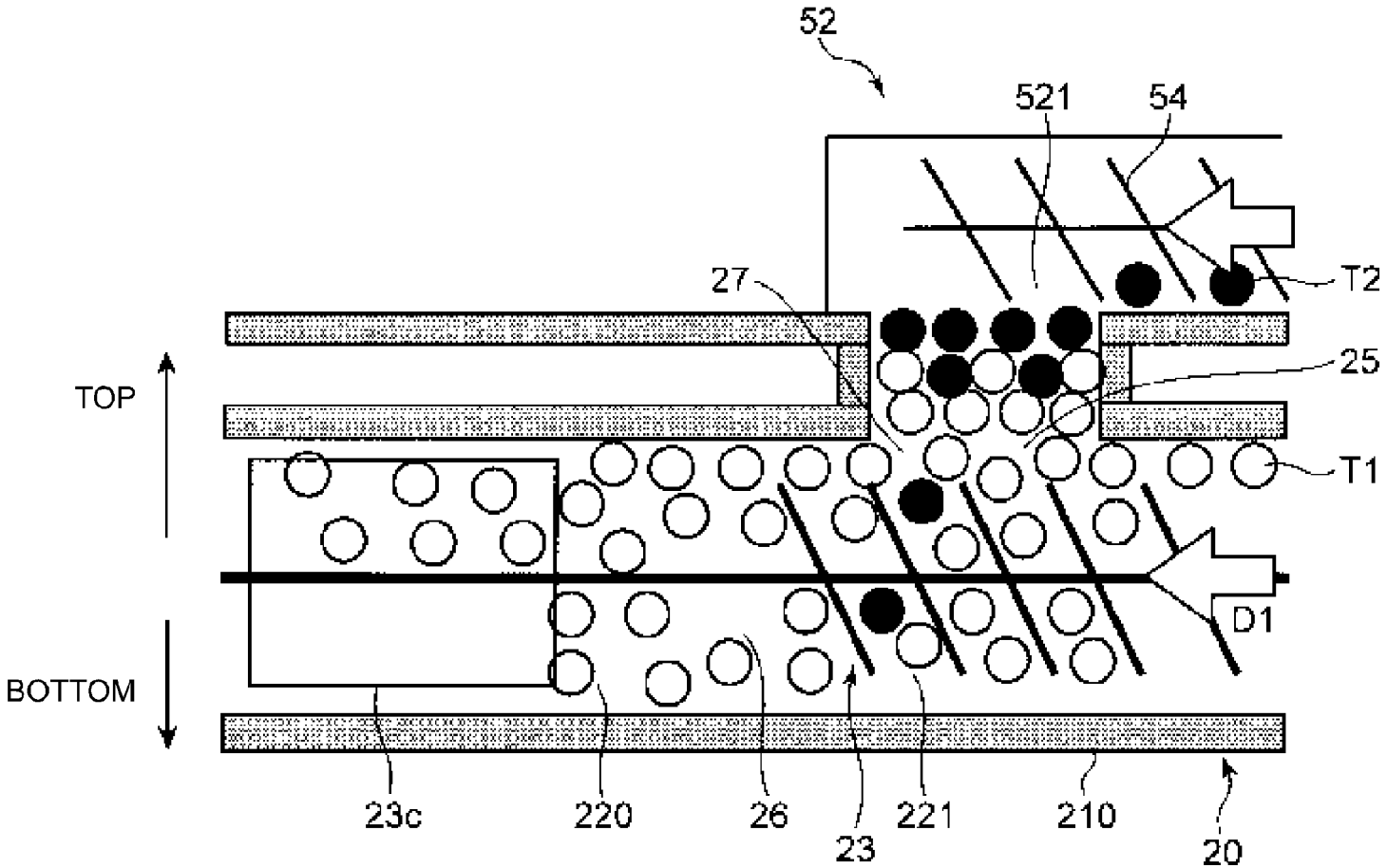
FIG. 5 is a pattern diagram showing how a toner is refilled in the developing device according to one embodiment of this disclosure.
Figure 6:
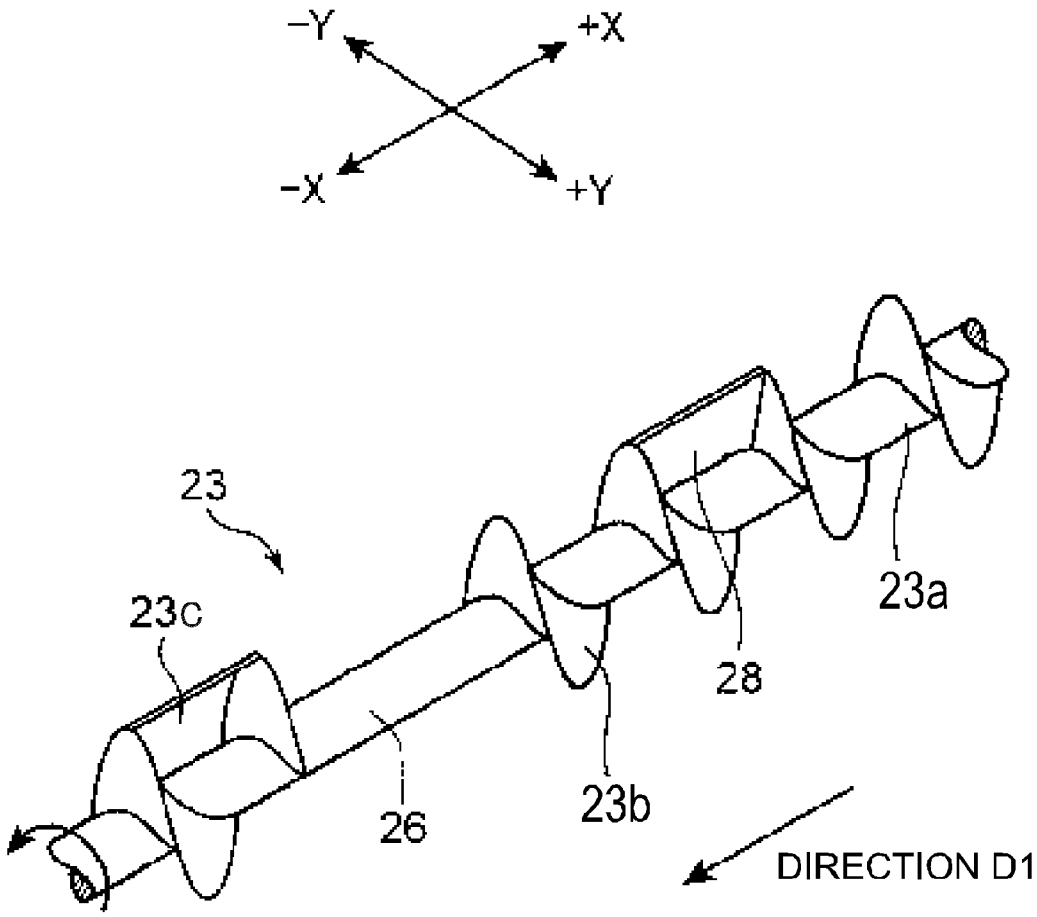
FIG. 6 is an enlarged perspective view of a first stirring screw of the developing device according to one embodiment of this disclosure.

Next, a flow of a toner newly refilled from the toner refill port 25 will be described. FIG. 5 is a sectional view of the toner refill port 25 disposed at the developing device 20 and the toner discharge port 521 disposed at the toner container 50 and their surroundings. Shown in FIG. 5 for description is arrangement of the toner container 50 rotated through 90 degrees in a horizontal direction. In practice, the rotation member 54 in the toner container 50 extends forwardly from a paper surface, and the first stirring screw 23 and the rotation member 54 in the toner container 50 have positional relationship such that they are orthogonal to each other. FIG. 6 is a partially enlarged perspective view of the first stirring screw 23.

A refill toner T2 supplied from the toner discharge port 521 of the toner container 50 drops into the first conveying path 221 and is mixed with an existing toner T1, and is conveyed in the direction of the arrow D1 by the first stirring screw 23. At this point, the toners T1 and T2 are stirred and charged.

The first stirring screw 23 includes, on a side downstream of the toner refill port 25 in the toner conveyance direction, a conveyance capability inhibition part 26 in which developer conveyance performance is partially inhibited. The conveyance capability inhibition part 26 is formed by omitting the first spiral blade 23*b* of the first stirring screw 23 (see FIG. 6). In this embodiment, an axial length of the conveyance capability inhibition part 26 is set at 12 mm. In other words, the conveyance capability inhibition part 26 corresponds to a portion at which only the first rotation axis 23*a* is partially disposed. In this case, the conveyance capability inhibition part 26 does not have developer conveyance performance for the axial direction of the first rotation axis 23*a*. Therefore, in the first conveying path 221, the toner conveyed from a side upstream of the conveyance capability inhibition part 26 starts to accumulates at the conveyance capability inhibition part 26. Then this toner accumulation cumulates to a position which is immediately upstream of the conveyance capability inhibition part 26 and at which the toner refill port 25 opposes the first conveying path 221. As a result, near an entrance of the toner refill port 25, an accumulation part 27 for the developer is formed.

Upon an increase in the amount of toner in the inner space 220 as a result of refill of the refill toner T2 from the toner refill port 25, the toner accumulating at this accumulation part 27 closes (seals) the toner refill port 25, inhibiting further toner refilling. Then upon a decrease in the toner accumulating at the accumulation part 27 as a result of consumption of the toner in the inner space 220 from the developing roller 21, the toner closing the toner refill port 25 deceases, forming a space between the accumulation part 27 and the toner refill port 25. As a result, the refill toner T2 flows again from the toner refill port 25 into the inner space 220. As described above, adopted in this embodiment is a toner refill method of a volume refill type by which the amount of refill toner to be received is adjusted following a decrease in the toner accumulating at the accumulation part 27.

<Refill Toner Dispersion>

In the developing device 20 provided with the toner refill method of the volume refill type as described above, upon a decrease in the toner remaining in the toner container 50, the amount of toner refilled decreases, which also results in a decrease in the amount of toner in the developing housing 210. In this case, upon detection by a toner sensor, not shown, that the aforementioned remaining toner is little, replacement of the toner container 50 is prompted. At this point, as described above, due to the decrease in the amount of toner in the developing housing 210, the amount of toner at the accumulation part 27 downstream of the toner refill port 25 also decreases. Then from a new toner container 50 fitted to the developing device 20 by a user, a refill toner flows into the developing housing 210. Since a large amount of toner is filled in the new toner container 50, the refill toner easily and vigorously flows towards the developing housing 210.

The toner flowing into the developing housing 210 enters into the accumulation part 27. Then following the driving of the first stirring screw 23 and the second stirring screw 24 into rotation, the toner is conveyed from the first conveying path 221 to the second conveying path 222. At this point, the large amount of refill toner refilled from the new toner container 50 into the developing housing 210 differs from the toner already circulated in the developing housing 210 in surface property and charging performance in many cases. As a result of circulation of the both toners in the developing housing 210, their properties gradually become close to each other, but immediately after the flow-in of the refill toner, toner charging may be polarized due to a difference between surfaces states of the both toners. That is, one of the toners described above is charged to a positive polarity, and the other thereof is charged to a negative polarity. As a result, developer fogging may occur on images on the photosensitive drum 31 and the sheet.

In addition, the new refill toner drastically flowing into the developing housing 210 hardly sinks towards a bottom part side of the developing housing 210 even when it receives rotational force of the first stirring screw 23. Especially at the conveyance capability inhibition part 26 downstream of the toner refill port 25, a toner stirring capability is low, and thus toner dispersion is hardly performed. In this case, the refill toner flowing into the developing housing 210 flows towards the second conveying path 222 via the first communication path 223 while flowing at a front layer (top layer, draft surface portion) of the toner layer of the first conveying path 221. Then as a result of directly supplying the developing roller 21 with the refill toner flowing into the second conveying path 222 without being dispersed sufficiently, there has arisen a problem that longitudinally linear developer fogging occurs on the image.

<Aperture Area of Communication Path>

To solve the problem as described above, in this embodiment, shapes of the first communication path 223 and the first stirring screw 23 are preferably set. Referring to FIG. 4, an aperture area of the first communication path 223 through which the toner passes is defined as A1. On the other hand, as shown as a partially sectional view in FIG. 4, a circular area formed by an outer circumferential edge of the first spiral blade 23*b* of the first stirring screw 23 in cross section orthogonal to the first rotation axis 23*a* is defined as A2. Then in this embodiment, relationship $0.5\times A2<A1<1.2\times A2$ is satisfied.

In the above, as a result of satisfying the relationship $A1>1.2\times A2$, a flow rate of the toner passing through the first communication path 223 is reduced. Thus, the toner accumulates at a downstream portion of the first conveying path 221 and pressure of this toner increases. As a result, the refill toner flowing from the toner refill port 25 is supplied towards the second conveying path 222 while sufficiently mixed with the surrounding toner at the downstream portion of the first conveying path 221. In other words, the refill toner is prevented from flowing towards the second conveying path 222 in an insufficiently dispersed state while flowing on the surface (draft surface) of the toner layer. Therefore, supply of a clump of the refill toner to the developing roller 21 is inhibited. Moreover, the polarization of charging of the both toners as a result of insufficient mixing between the refill toner and the toner circulated in the developing housing 210 is inhibited. Further, as a result of satisfying relationship $A1<1.0\times A2$, dispersion of the refill toner is further promoted.

Moreover, as a result of satisfying relationship $0.5\times A2<A1$, setting the first communication path 23 to be excessively narrow is prevented. Thus, a decrease in the mount of toner on the developing roller 21 as a result of shortage of toner supply from the first conveying path 221 to the second conveying path 222 is prevented. Moreover, as a result of satisfying the relationship $0.8\times A2<A1$, even more stable toner supply from the first conveying path 221 to the second conveying path 222 is realized.

As a result, the following effect is provided where the aperture area A1 of the first communication path 223 through which the developer is delivered from the first conveying path 221 to the second conveying path 222 and the aforementioned area A2 are set such that relationship $0.5\times A2<A1<1.2\times A2$ is satisfied. The developer accumulates at the downstream portion of the first conveying path, and the pressure of the developer increases. As a result, the refill developer flowing from a developer receiving port is supplied towards the second conveying path while sufficiently mixed with the surrounding developer at the downstream portion of the first conveying path. In other words, flowing of the refill developer towards the second conveying path in an insufficiently dispersed state while flowing on the surface of the developer layer is inhibited. Therefore, the supply of the clump of the refill developer to the developing roller is inhibited. Moreover, the polarization of the developer charging as a result of insufficient mixing between the refill developer and the developer circulated in the developing housing is inhibited. Further, a decrease in the amount of developer on the development roller as a result of shortage of developer supply from the first conveying path to the second conveying path is prevented.

Moreover, in this embodiment, as shown in FIG. 4, the conveyance capability inhibition part 26 is arranged on the side upstream of the first communication path 223 in the conveyance direction (the direction of the arrow D1, the first direction) of the first stirring screw 23. That is, in a direction (the direction of the arrow D3) orthogonal to the conveyance direction, the conveyance capability inhibition part 26 does not oppose the first communication path 223. Thus, the toner located at surroundings of the conveyance capability inhibition part 26 provided with inhibited dispersion performance is prevented from flowing towards the second conveying path 222 via the first communication path 223.

Moreover, another embodiment of this disclosure refers to an image forming apparatus 1 provided with the developing device 20. In this image forming apparatus 1, flowing of the refill developer towards the second conveying path in the insufficiently dispersed state while flowing on the surface of the development layer is inhibited. Therefore, the supply of the clump of refill developer to the developing roller is inhibited. As a result, occurrence of longitudinally-linear developer fogging on the image formed on the sheet can be preferably prevented. Moreover, the polarization of developer charging as a result of insufficient mixing between the refill developer and the developer circulated in the developing housing is inhibited. As a result, occurrence of developer fogging on the entire surface of the image formed on the sheet is inhibited. Further, a decrease in the amount of developer on the developing roller as a result of shortage of developer supply from the first conveying path to the second conveying path is prevented. As a result, even in a case where an image with high print ratio is successively formed, occurrence of concentration deterioration is prevented.

EXAMPLES

Next, a description will be given based on Examples of this embodiment, but this embodiment is not limited to the Examples below. Each of the following Examples is performed under the following experiment condition.

<Experiment Condition>

Photosensitive drum 31: OPC drum

Circumferential speed of the photosensitive drum 31: 146 mm/sec

Layer regulating gap G: 0.3 mm

Developing bias AC component: rectangular wave amplitude 1.7 kV, Duty 50%

Developing bias DC component: 270V

Surface potential of the photosensitive drum 31 (background part/image part): 430V/30V Diameter of the developing roller 21: 16 mm Diameter of the photosensitive drum 31: 24 mm Average particle diameter of the magnetic toner: 6.8 μm (D50)

Number of rotations of the first stirring screw 23 and the second stirring screw 24: 50 rpm Outer diameter of the first stirring screw 23 and the second stirring screw 24: 14 mm Pitch of the first spiral blade 23*b* and the second spiral blade 24*b*: 20 mm Axial length of the conveyance capability inhibition part 26: 8 mm Axial length of the first paddle 23*c*: 18 mm Aperture shape of the toner refill port 25: 14 mm×8 mm Shortest axial distance between the toner refill port 25 and the first communication path 223: 10 mm Shortest axial distance between the toner refill port 25 and the second communication path 224: 139 mm <Experiment Procedures>

As the experiment procedures, the image forming apparatus 1 (developing device 20) is first exposed to an environment of 28 degrees Celsius/80% for three days. As a result, charge quantity q/m of the toner in the developing device 20 decreases to 3 μC/g, setting a state in which linear fogging easily occurs. In this state, a new toner container 50 is fitted to the image forming apparatus 1 (developing device 20), the aperture shape of the first communication path 223 is changed, and linear fogging, fogging at time of replacement of the toner container 50, and a concentration following capability are evaluated. FIGS. 7A and 7B, 8A and 8B, and 9A to 9C are elevation views illustrating shapes of the enrolled feature 233 and its surroundings under each experiment condition.

The linear fogging is an image quality defect caused when the clump of refill toner is supplied to the developing roller 21. For the evaluation of the linear fogging, 1000 sheets of a pattern with an image density of 3.8% are printed, and the number of sheets, out of the 1000 sheets, where the image detect is found is used. If the linear fogging occurs in the 10 or less sheets out of the 1000 sheets, it is evaluated as a rank 5, if it occurs in the 11 to 20 sheets, it is evaluated as a rank 4, if it occurs in the 21 to 50 sheets, it is evaluated as a rank 3, if it occurs in the 51 to 100 sheets, it is evaluated as a rank 2, and if it occurs in the 101 or more sheets, it is evaluated as a rank 1.

Figure 7A:
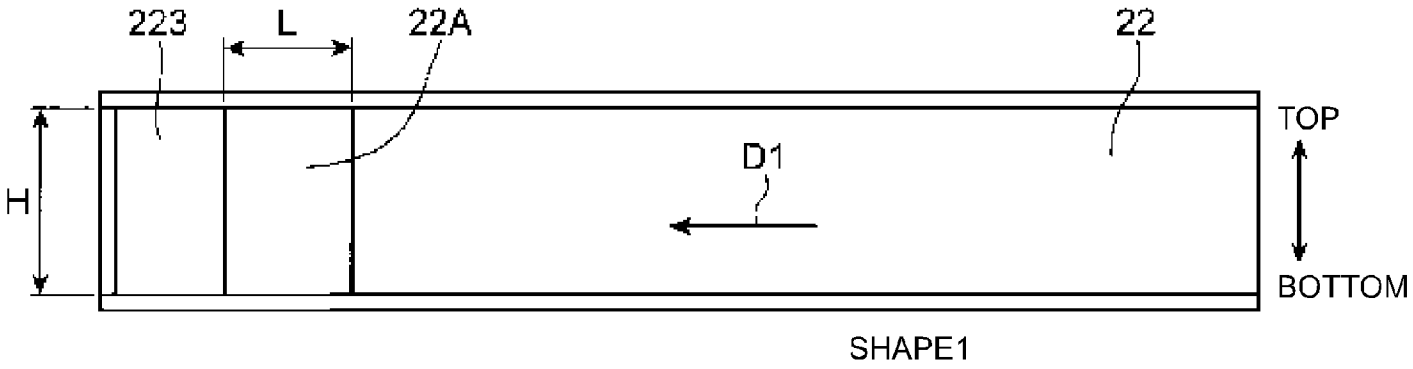
FIGS. 7A and 7B are elevation views illustrating shapes of auxiliary partition boards according to one embodiment of this disclosure.

1 shown in FIG. 7A. In this figure, a maximum aperture width of the first communication path 223 was set at 20 mm, and the aperture area A1 under each condition was set by changing an upper side L of the auxiliary partition board 22A closing a right side of the first communication path 223. The first stirring screw 23 and the second stirring screw 24 are both rotated in a direction from a top to a bottom in a region opposing the partition board 22.

TABLE 1

| Sectional area A2 of the first stirring screw 23: 153.9 mm$^2$ | Comparative Example 1 | 2 | 3 | 4 | 5 | Example 1 | 2 | 3 | 4 | 5 | 6 | 7 | 8 | 9 | Comparative Example 6 |
|---|---|---|---|---|---|---|---|---|---|---|---|---|---|---|---|
| Width of the first communication path 223 20-L (mm) | 19 | 18 | 17 | 16 | 15 | 14 | 13 | 12 | 11 | 10 | 9 | 8 | 7 | 6 | 5 |
| Aperture area A1 of the first communication path 223 (mm$^2$) | 247 | 234 | 221 | 208 | 195 | 182 | 169 | 156 | 149.5 | 143 | 130 | 117 | 104 | 78 | 65 |
| Ratio A1/A2 | 1.61 | 1.52 | 1.44 | 1.35 | 1.27 | 1.18 | 1.1 | 1.01 | 0.97 | 0.93 | 0.84 | 0.76 | 0.68 | 0.51 | 0.42 |
| Fogging at time of replacement of the toner container 50 (Rank) | 1 | 1 | 1 | 2 | 2 | 3 | 4 | 4 | 5 | 5 | 5 | 5 | 5 | 5 | 5 |
| Image quality defect in case of following with an image density of 100% | ○ | ○ | ○ | ○ | ○ | ○ | ○ | ○ | ○ | ○ | ○ | Δ | Δ | Δ | X |
| Image quality defect in case of following with an image density of 50% | ○ | ○ | ○ | ○ | ○ | ○ | ○ | ○ | ○ | ○ | ○ | ○ | ○ | ○ | X |
| Rotation direction of the first stirring screw 23 | Top → Bottom | | | | | | | | | | | | | | |
| Rotation direction of the second stirring screw 24 | Top → Bottom | | | | | | | | | | | | | | |
| Linear fogging (Rank) | 1 | 1 | 1 | 1 | 1 | 2 | 2 | 2 | 3 | 3 | 3 | 4 | 4 | 4 | 5 |

The fogging at the time of replacement of the toner container 50 is an image quality defect caused as a result of polarization of charging between the refill toner and the toner circulated in the developing housing 210. The evaluation of this fogging is performed through sample visual checking based on the following criterion.

Rank 1: Very conspicuous fogging is present.

Rank 2: A little conspicuous fogging is present.

Rank 3: Fogging is present at a less noticeable level.

Rank 4: Slight fogging is present but it is almost unnoticeable.

Rank 5: No fogging is present, or fogging is completely unnoticeable.

Moreover, the evaluation of the concentration following capability is achieved based on concentration deterioration caused upon shortage of the toner supply to the developing roller 21 due to the too narrow first communication path 223. More specifically, it is evaluated whether or not the concentration deterioration occurs when samples with image densities of 100% and 50%, respectively, are printed successively.

Experiment 1

Table 1 shows evaluation results on the linear fogging, etc. in a case where a ratio between the aperture area A1 and a sectional area A2 is changed. The sectional area A2 of the first stirring screw 23 is 153.9 mm$^2$. The shape of the first communication path 223 in Experiment 1 corresponds to a shape In Table 1, where the ratio between the aperture area A1 and the sectional area A2(A1/A2) is in a range of 0.5<A1/A2<1.2 (Examples 1 to 9), the fogging at the time of replacement of the toner container 50 was at the rank 3 or higher and the linear fogging was at the rank 2 or higher. Moreover, in the evaluation of the concentration following capability, the following was possible without causing concentration deterioration even for the image density of 50%. Further, in the range of 0.8<A1.A2<1.0 (Examples 4 to 6), the fogging at the time of replacement of the toner container 50 was at the rank 5, and the linear fogging was at the rank 3 or higher. Moreover, following was possible without causing concentration deterioration even for the image density of 100%. In Example 6, since the first communication path 223 is too narrow, shortage of the toner supply to the second conveying path 222 occurs, resulting in x for the concentration following capability.

As described above, by setting the ratio (A1/A2) between the aperture area A1 and the sectional area A2, the toner accumulates at the downstream portion of the first conveying path 221 and the pressure of this toner increases. As a result, the refill toner flowing from the toner refill port 25 is supplied towards the second conveying path 222 while sufficiently mixed with the surrounding toner at the downstream portion of the first conveying path 221. In other words, flowing of the refill toner towards the second conveying path 222 in an insufficiently dispersed state while flowing on the surface of the toner layer is prevented. Therefore, the supply of the clump of the refill toner to the developing roller 21 was inhibited, preferably preventing linear fogging. Moreover, the polarization of the toner charging as a result of insufficient mixing between the refill toner and the toner circulated in the developing housing 210 was inhibited, and the fogging at the time of replacement of the toner container 50 was prevented. Further, a decrease in the amount of toner on the developing roller 21 as a result of shortage of toner supply from the first conveying path 221 to the second conveying path 222 was inhibited, preferably maintaining the concentration following cap ability.

Next, Table 2 shows results of Experiment 2 in which rotation directions of the first stirring screw 23 and the second stirring screw 24 were changed with the shape of the first communication path 223 in Example 6 above.

TABLE 2

Sectional area A2 of the first stirring screw 23: 153.9 $mm^2$

| | Example 6 | Example 10 | Example 11 | Example 12 |
|---|---|---|---|---|
| Width of the first communication path 223 (mm) | 10 | 10 | 10 | 10 |
| Aperture area A1 of the first communication path 223 ($mm^2$) | 130 | 130 | 130 | 130 |
| Ratio A1/A2 | 0.84 | 0.84 | 0.84 | 0.84 |
| Fogging at time of replacement of the toner container 50 (Rank) | 5 | 5 | 5 | 5 |
| Image quality defect in case of following with an image density of 100% | ○ | ○ | ○ | Δ |
| Image quality defect in case of following with an image density of 50% | ○ | ○ | ○ | ○ |
| Rotation direction of the first stirring screw 23 | Top →Bottom | Bottom →Top | Bottom →Top | Top → Bottom |
| Rotation direction of the second stirring screw 24 | Top →Bottom | Bottom →Top | Top → Bottom | Bottom →Top |
| Linear fogging (Rank) | 3 | 2 | 2 | 2 |

As shown in Table 2, the linear fogging was further prevented in Example 6 in comparison to a case (Example 10) where the first stirring screw 23 and the second stirring screw 24 are each rotated from the bottom to the top with respect to the partition board 22 or cases (Examples 11 and 12) where either of the aforementioned screws is rotated from the bottom to the top with respect to the partition board 22.

In the case where the first stirring screw 23 is rotated from the bottom to the top with respect to the partition board 22, a large quantity of toner is fed to the second communication path 224 along the bottom part of the developing housing 210 by rotational force of the first paddle 23*c*. Thus, linear fogging easily occurs. Contrarily, in the case where the second stirring screw 24 is rotated from the bottom to the top with respect to the partition board 22, by rotational force of the second stirring screw 24, the toner temporarily counterflows from the second conveying path 222 to the first conveying path 221, but a space is formed in a region of the second stirring screw 24 though which the second spiral blade 24*b* passes and thus the toner is vigorously drawn into this space. As a result, the linear fogging easily occurs. On the contrary, in a case where the first stirring screw 23 and the second stirring screw 24 are rotated from the top to the bottom with respect to the partition board 22, force by which the toner is forcefully fed towards the second conveying path 222 as described above weakens. Thus, the toner is less likely to be conveyed towards the second conveying path 222 at once, preferably suppressing occurrence of the linear fogging.

Experiment 3

Next, Table 3 shows evaluation results of Experiment 3 related to the arrangement of the first communication path 223. This evaluation is performed with the shapes 1 and 2 shown in FIGS. 7A and 7B. That is, in Example 13 of Table 3, as shown in FIG. 7A, the auxiliary partition board 22A that closes a top portion as a portion of the first communication path 223 is provided in a height direction of the partition board 22, and the first communication path 223 at the same height as the partition board 22 is arranged on a downstream side in the first direction (the arrow D1). On the other hand, adopted in Example 14 is a shape in which the top portion of the first communication path 223 is closed while the maximum aperture width L (20 mm) of the first communication path 223 is maintained. As described above, a member that partially closes the top of the first communication path 223 on the downstream side in the first direction of the first communication path 223 is referred to as auxiliary partition board 22B. The auxiliary partition board 22B is arranged in the developing housing 210. In Experiment 3, the first stirring screw 23 and the second stirring screw 24 are both rotated in a direction from the top to the bottom in the region opposing the partition board 22.

TABLE 3

Sectional area A2 of the first stirring screw 23: 153.9 $mm^2$

| | Example 13 | Example 14 |
|---|---|---|
| Width of the first communication path 223 (mm) | 10 | 20 |
| Aperture area A1 of the first communication path 223 ($mm^2$) | 130 | 140 |
| Ratio A1/A2 | 0.84 | 0.91 |
| Upper side length L (mm) | 10 | 20 |
| Height H (mm) | 13 | 6 |
| Shape | 1 | 2 |
| Rotation direction of the first stirring screw 23 | T→B | |
| Rotation direction of the second stirring screw 24 | T→B | |
| Linear fogging (Rank) | 3 | 4 |

As shown in Table 3, in Example 14, although the aperture area of the first communication path 223 is slightly larger than that in Example 13, the linear fogging is more improved than in Example 13. This is because, even when the refill toner is conveyed to the top layer of the toner layer in a biased manner in the first conveying path 221, the refill toner flows towards the second conveying path 222 while sinking to the bottom of the auxiliary partition board 22B. By sinking to the bottom of the toner layer, the refill toner is preferably mixed with the surrounding toner. Moreover, following the rotation of the second stirring screw 24, the refill toner flows into a bottom portion of the second stirring screw 24 that is rotated in a direction separated from the partition board 22. As a result, after the refill toner is sufficiently dispersed, it is supplied to the developing roller 21.

Experiment 4

Figure 8A:
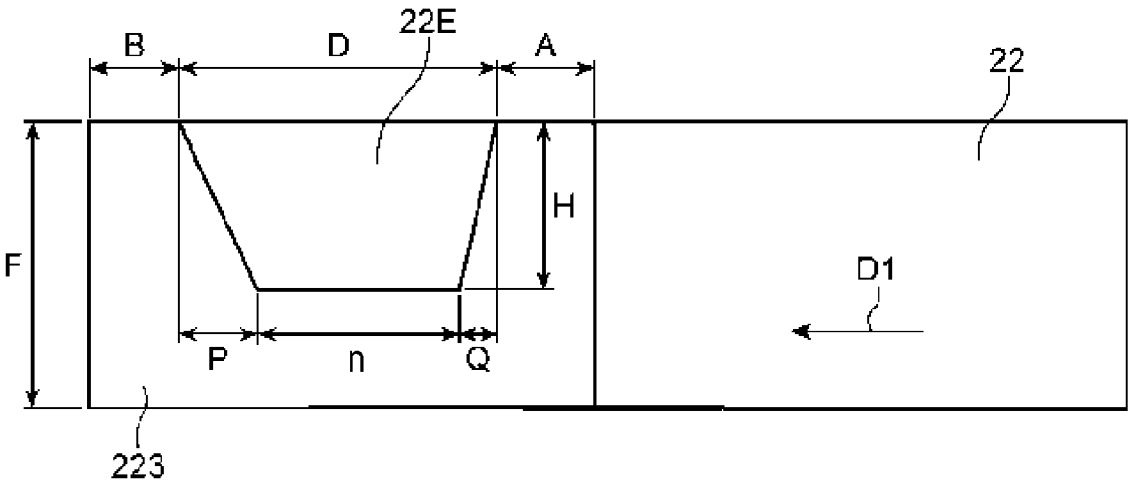
FIG. 8A is an elevation view illustrating a shape of an auxiliary partition board according to one embodiment of this disclosure.
Figure 8B:
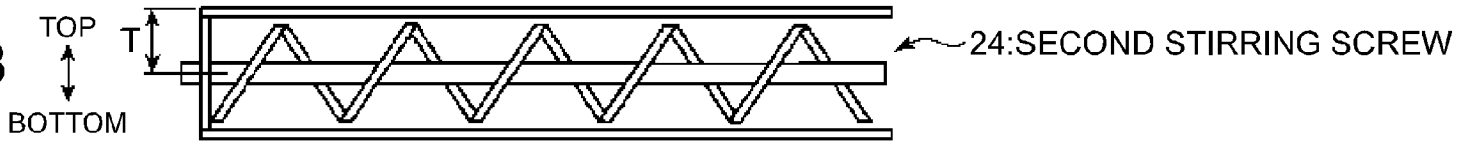
FIG. 8B is an elevation view of a second stirring screw.
Figure 9A:
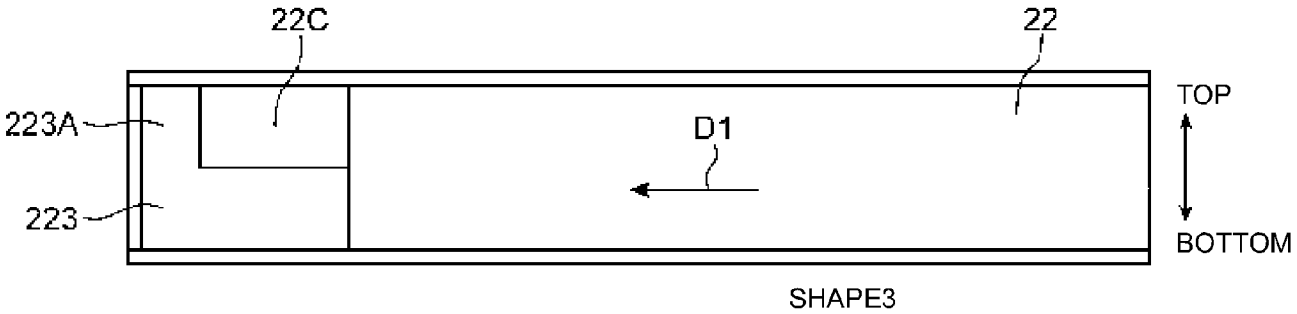
FIGS. 9A, 9B, and 9C are elevation views illustrating shapes of auxiliary partition boards according to one embodiment of this disclosure.
Figure 9B:
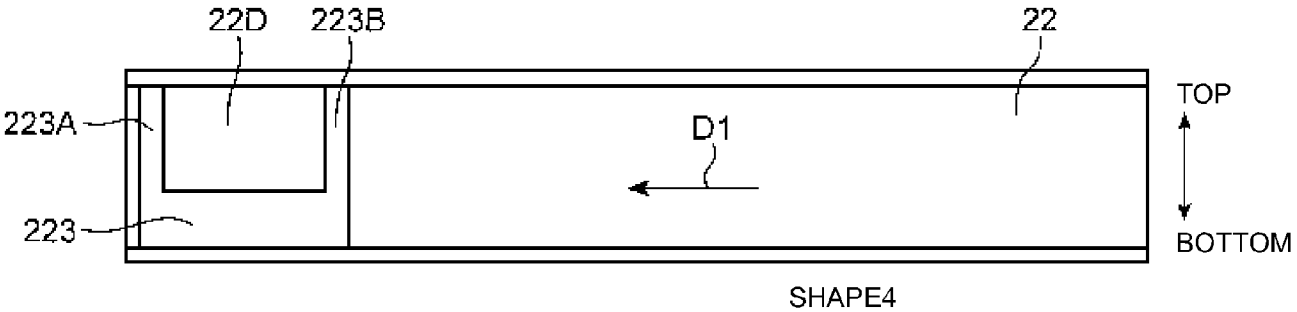
Figure 9C:
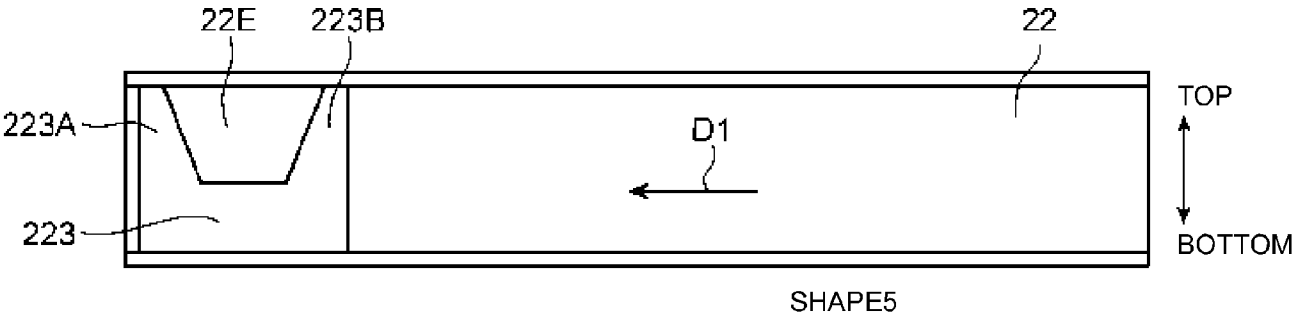

Next, Table 4 shows Experiment 4 in which a shape and arrangement of the aforementioned auxiliary partition board 22B are changed. In Experiment 4, each shape parameter of the surroundings of the first communication path 223 shown in FIGS. 8A and 8B are changed, and in addition to the aforementioned linear fogging, the fogging at the time of replacement of the toner container 50, and the concentration following capability, pitch unevenness is evaluated. When part of the first communication path 223 is closed by, for example, the auxiliary partition board 22B upon conveyance of the toner to the downstream side in the first direction in the first conveying path 221, rotation torque of the first stirring screw 23 is likely to increase. As a result, oscillation following a rotation cycle of the first stirring screw 23 may be transmitted to the developing roller 21. In this case, a variation in the amount of toner supplied from the developing roller 21 to the photosensitive drum 31 occurs, causing pitch unevenness on the image. In Table 4, whether or not this pitch unevenness is present is evaluated at the same time. The pitch unevenness ○ denotes a level visually unidentifiable, and the pitch unevenness Δ denotes that the pitch unevenness can be slightly identified. Moreover, for the "shapes" of the first communication path 223 in Table 4, "shape 3", "shape 4", and "shape 5" are schematically shown in FIGS. 9A, 9B, and 9C, respectively. In the figures, auxiliary partition boards 22C, 22D, and 22E are arranged in the developing housing 210.

TABLE 4

| Sectional area A2 of the first stirring screw 23: 153.9 mm$^2$ | Example | | | | | | | | | |
|---|---|---|---|---|---|---|---|---|---|---|
| | 15 | 16 | 17 | 18 | 19 | 20 | 21 | 22 | 23 | 24 |
| Rotation axis position T of the second stirring screw 24 (mm) | 7.5 | 7.5 | 7.5 | 7.5 | 7.5 | 7.5 | 7.5 | 7.5 | 7.5 | 7.5 |
| Axis diameter of the second rotation axis 24a (mm) | 5 | 5 | 5 | 5 | 5 | 5 | 5 | 5 | 5 | 5 |
| Shape | 2 | 3 | 4 | 5 | 5 | 5 | 5 | 5 | 5 | 5 |
| Top side D (mm) | 20 | 15 | 15 | 15 | 18 | 16 | 16 | 16 | 16 | 20 |
| Bottom side n (mm) | 20 | 15 | 15 | 11 | 14 | 14 | 13 | 7 | 4 | 0 |
| Height H (mm) | 6 | 6 | 6 | 6 | 12 | 10 | 8 | 8 | 8 | 7.5 |
| Left aperture length B (mm) | 0 | 5 | 3 | 3 | 0 | 0 | 2 | 2 | 2 | 2 |
| Right aperture length A (mm) | 0 | 0 | 2 | 2 | 2 | 2 | 2 | 2 | 2 | 2 |
| Bottom aperture height F-H (mm) | 7 | 7 | 7 | 7 | 1 | 3 | 5 | 5 | 5 | 5.5 |
| Auxiliary partition board area (mm$^2$) | 120 | 90 | 90 | 78 | 180 | 150 | 116 | 92 | 80 | 75 |
| Aperture area A1 of the first communication path 223 (mm$^2$) | 140 | 170 | 170 | 182 | 80 | 110 | 144 | 168 | 180 | 185 |
| Ratio A1/A2 | 0.91 | 1.1 | 1.1 | 1.18 | 0.52 | 0.71 | 0.94 | 1.09 | 1.17 | 1.2 |
| Fogging at time of container replacement | 5 | 4 | 4 | | | | 5 | | | |
| Image quality defect in case of following with an image density of 100% | ○ | ○ | ○ | | | | ○ | | | |
| Image quality defect in case of following with an image density of 50% | ○ | ○ | ○ | ○ | ○ | ○ | ○ | ○ | ○ | ○ |
| Rotation direction of the first stirring screw 23 | Top → Bottom | | | | | | | | | |
| Rotation direction of the second stirring screw 24 | Top → Bottom | | | | | | | | | |
| Linear fogging (Rank) | 4 | 3 | 3 | 2 | 5 | 5 | 5 | 5 | 3 | 1 |
| Pitch unevenness | Δ | ○ | ○ | ○ | ○ | ○ | ○ | ○ | ○ | ○ |

In Table 4, in Examples 15 to 18, bottom end parts (H) of the auxiliary partition boards 22C, 22D, and 22E are arranged above a position (T) of an axis center of the second rotation axis 24*a* of the second stirring screw 24. On the other hand, in Examples 19 to 24, the bottom end parts (H) of the auxiliary partition boards 22C, 22D, and 22E are so arranged as to be flushed with the position (T) of the axis center of the second rotation axis 24*a* of the second stirring screw 24 or therebelow. Then in comparison of a region with the same aperture area A1, in the case where the bottom end parts (H) of the auxiliary partition boards 22C, 22D, and 22E are arranged blow the position (T) of the axis center of the second rotation axis 24*a* of the second stirring screw 24, the liner fogging is even more improved. In this case, refill toner dispersion is promoted and also the toner reliably flows into the bottom portion of the second stirring screw 24, thus preferably preventing the linear fogging.

Figure 7B:
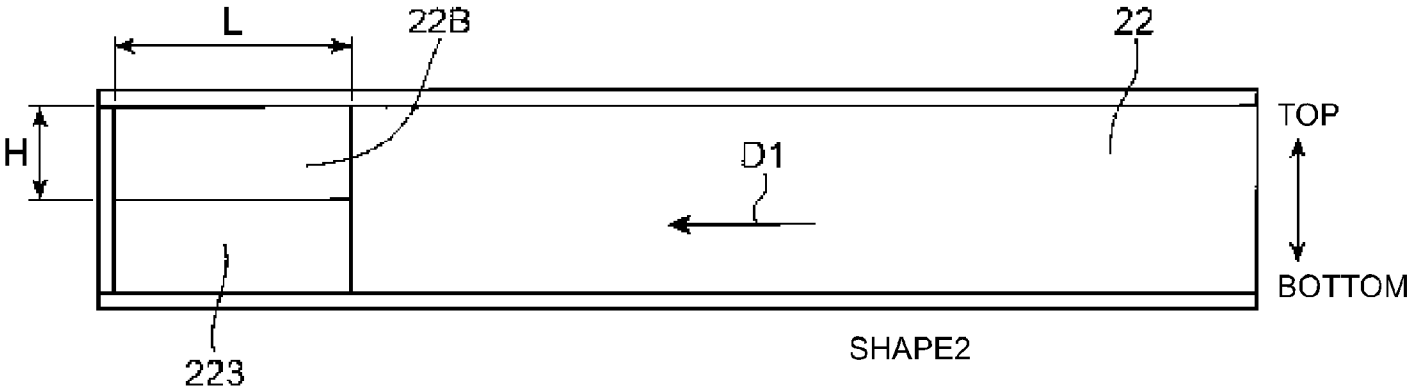

Further, in Example 15 of Table 4, as shown in FIG. 7B, the top of an end part of the first communication path 223 on the downstream side in the first direction is closed by the auxiliary partition board 22B. On the contrary, in Examples 16 to 18, as shown in FIGS. 9A, 9B, and 9C, at the top of the first communication path 223 on the downstream side in the first direction, a downstream side auxiliary communication part 223A is formed which communicates with the first communication path 223. As a result, a stable image is formed without causing the aforementioned pitch unevenness. That is, even in a case where the top portion of the first communication path 223 is closed by the auxiliary partition boards 22C, 22D, and 22E, the toner can partially flow towards the second conveying path 222 from the downstream side auxiliary communication part 223A. Thus, at the downstream side end part of the first conveying path 221, the toner conveyed by the first stirring screw 23 is condensed, preventing occurrence of torque up of the first communication path 223 and pitch unevenness. Further, as shown in FIGS. 9B and 9C, an upstream side auxiliary communication part 223B may be arranged in the first communication path 223. The auxiliary partition board 22B communicates with the first communication path 223 on a side upstream of the auxiliary partition boards 22D and 22E in the first direction and also between the auxiliary partition boards 22D and 22E and the partition board 22. In this case, also from the upstream side auxiliary communication part 223B, the toner can partially flow towards the second conveying path 222. Thereby, the responsibility can be decreased when the toner pass through the first communication path 223 in the downstream side auxiliary communication part 223A. The auxiliary partition board 22E, in a side view from a direction orthogonal to the first direction, has side parts of the downstream side auxiliary communication part 223A and the upstream side auxiliary communication part 223B inclined such that a width of the auxiliary partition board 22E in the first direction increasingly shortens towards the bottom.

The developing device 20 according to the embodiment of this disclosure and the image forming apparatus 1 provided with this developing device 20 have been described above, but this disclosure is not limited to this, and for example, the following modified embodiment can be adopted.

(1) In the embodiment above, toner refilling from the toner container 50 to the developing device 20 has been described in a mode in which it is adjusted by the conveyance capability inhibition part 26 (accumulation part 27), but this disclosure is not limited to this. A mode may be such that in accordance with results of detection by a concentration sensor, not shown, that detects image concentration or by a toner sensor, not shown, that detects the amount of toner in the developing housing 210, the toner is refilled from the toner container 50 to the development housing 210.

(2) In the embodiment above, as a result of satisfying predetermined relationship by the aperture areas A1 and A2, flowing of the refill toner towards the second conveying path 222 in a non-dispersed manner is prevented. This disclosure is not limited to this. In addition to the aforementioned relationship between the aperture areas described above, as shown in FIG. 4, an upstream side paddle 28 may be arranged on an upstream side of the toner refill port 25. The upstream side paddle 28, as is the case with the conveyance capability inhibition part 26, has a function of partially deteriorating the toner conveyance performance of the first stirring screw 23 on the upstream side of the toner refill port 25. By the upstream side paddle 28, also on the upstream side of the toner refill port 25, an upstream side accumulation part 29 is formed in which the toner partially accumulates. As a result, when a new toner container 50 is fitted, flowing of a large amount of refill toner to the upstream side of the toner refill port 25 is preferably prevented. Therefore, the flowing of the large amount of refill toner towards the second conveying path 222 while flowing at the top layer of the toner layer is prevented.

(3) In the embodiment above, a mode in which the magnetic toner is adopted as the developer has been described, but this disclosure is not limited to this. As the developer, a non-magnetic toner or a two-component developer may be adopted.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A developing device comprising:

a housing including a pair of wall parts;

a developing roller being rotatably supported in the housing between the pair of wall parts, and carrying a developer;

a developer conveying path including in the housing: a first conveying path being arranged in a manner such as to be spaced from the developing roller and conveying the developer in a first direction; and a second conveying path being arranged between the developing roller and the first conveying path, conveying the developer in a second direction opposite to the first direction, and supplying the developer to the developing roller;

a partition board being arranged in the housing in a manner such as to extend in a direction orthogonal to the pair of wall parts, and partitioning the first conveying path and the second conveying path;

a first communication path and a second communication path respectively being arranged between the pair of wall parts and both end parts of the partition board, the first communication path passing the developer from the first conveying path to the second conveying path, the second communication path passing the developer from the second conveying path to the first conveying path;

a developer receiving port being disposed at a position on a downstream side in the first direction of the first conveying path in the housing, and receiving a refill developer into the developer conveying path;

a first conveying member being disposed in the first conveying path, including a first rotation axis, being driven into rotation around the first rotation axis, and conveying the developer in the first direction in the first conveying path in a manner such that the developer passes through a position opposing the developer receiving port;

a second conveying member being disposed in the second conveying path, including a second rotation axis, being driven into rotation around the second rotation axis, and conveying the developer in the second direction; and a conveyance capability inhibition part being arranged on a side downstream of the developer receiving port of the first conveying member in the first direction and partially inhibiting a capability of conveying the developer by the first conveying member to thereby form an accumulation part for the developer at a position opposing the developer receiving port, wherein, where an aperture area of a region in the first communication path through which the developer passes is defined as A1 and an area of a circular section formed by an outer circumferential edge of the first conveying member in section orthogonal to the first rotation axis is defined as A2, relationship:

$$0.5 \times A2 < A1 < 1.2 \times A2$$

is satisfied.

2. The developing device according to claim 1, wherein the first conveying member and the second conveying member are rotated from a top to a bottom in a region opposing the partition board.

3. The developing device according to claim 2, wherein the first communication path is formed by notching the partition board by a degree corresponding to a height thereof, and an auxiliary partition board is provided, the auxiliary partition board being arranged in the housing and closing an top portion as a portion of the first communication path in a direction along the height.

4. The developing device according to claim 3, wherein, on a side downstream of the auxiliary partition board in the first direction in the first communication path, a downstream side auxiliary communication part passing the developer towards the second conveying path is formed.

5. The developing device according to claim 4, wherein, on a side upstream of the auxiliary partition board in the first direction, an upstream side auxiliary communication part is provided, the upstream side auxiliary communication part being arranged between the auxiliary partition board and the partition board and communicating with the first communication path.

6. The developing device according to claim 5, wherein the auxiliary partition board, in a sectional view from a direction orthogonal to the first direction, has both side parts of the downstream side auxiliary communication part and the upstream side auxiliary communication part inclined such that a width of the auxiliary partition board in the first direction increasingly shortens toward a bottom.

7. The developing device according to claim 3, wherein a bottom end part of the auxiliary partition board is arranged below a axis center of the second rotation axis of the second conveying member.

8. The developing device according to claim 1, wherein the aperture area A1 and the area A2 further satisfies relationship:

$$0.8 \times A2 < A1 < 1.0 \times A2.$$

9. The developing device according to claim 1, wherein the first and second conveying members have screw blades formed around the first and second rotation axes, and an outer edge of the screw blade forms an outer circumferential edge of the first conveying member.

10. The developing device according to claim 8, wherein the conveyance capability inhibition part is formed by omitting the screw blade of the first conveying member.

11. The developing device according to claim 1, wherein the conveyance capability inhibition part is arranged on a side upstream of the first communication path in the first direction.

12. An image forming apparatus comprising:

the developing device according to claim 1;

an image carrier having an electrostatic latent image formed on a surface thereof, the image carrier receiving the developer supplied from the developing roller; and a transfer device transferring the image from the image carrier onto a sheet.

* * * * *